US007810509B2

(12) United States Patent
Kuzuu

(10) Patent No.: US 7,810,509 B2
(45) Date of Patent: Oct. 12, 2010

(54) BRUSH FOR APPLICATION OF MASCARA OR THE LIKE

(75) Inventor: Miki Kuzuu, Tochigi (JP)

(73) Assignee: Mikio Kuzuu, Tochigi-shi (JP)

( * ) Notice: Subject to any disclaimer, the term of this patent is extended or adjusted under 35 U.S.C. 154(b) by 1495 days.

(21) Appl. No.: 10/537,398

(22) PCT Filed: Aug. 31, 2004

(86) PCT No.: PCT/JP2004/012574

§ 371 (c)(1),
(2), (4) Date: Jun. 15, 2005

(87) PCT Pub. No.: WO2005/023048

PCT Pub. Date: Mar. 17, 2005

(65) Prior Publication Data

US 2006/0054179 A1 Mar. 16, 2006

(30) Foreign Application Priority Data

Sep. 3, 2003 (JP) ..... 2003-351331

(51) Int. Cl.
*A45D 40/26* (2006.01)

(52) U.S. Cl. ..... 132/218; 15/186; 15/207.2

(58) Field of Classification Search ..... 15/159.1, 15/160, 186–188, 206, 207.2; 132/120, 318, 132/320; D4/127, 128, 130–134, 136
See application file for complete search history.

(56) References Cited

U.S. PATENT DOCUMENTS 422,117 A * 2/1890 Christoffel ..... 15/104.16
1,179,426 A * 4/1916 Hamilton ..... 15/167.1
2,599,191 A * 6/1952 Meunier ..... 15/167.1
2,689,968 A * 9/1954 Rissler ..... 15/236.01
4,211,217 A * 7/1980 Gueret ..... 601/137
4,406,032 A * 9/1983 Diamant ..... 15/167.1
4,619,012 A 10/1986 Wachtel
4,744,377 A * 5/1988 Dolan, Jr. ..... 132/218

(Continued)

FOREIGN PATENT DOCUMENTS

EP 0 038 524 A2 10/1981

(Continued)

OTHER PUBLICATIONS

Translation of Jan. 18, 2010 Indian Office Action issued in Indian Patent Application No. 2509/DELNP/2005.

(Continued)

*Primary Examiner*—Mark Spisich
(74) *Attorney, Agent, or Firm*—Oliff & Berridge, PLC

(57) ABSTRACT

There is provided a brush for application of mascara or the like, comprising a brush core and bristles held on the brush core, wherein each of the bristles is in a shape of ring such as circle or ellipse of two-dimensional or three-dimensional planar or spatial curve and is held on the brush core in such a manner that a face of the bristle is at an angle of 0° to 90° with a longitudinal axis of the brush core. The brush, such as mascara brush makes it possible to apply quickly, simply and beautifully mascara even in a large amount onto the eyelashes by gently stroking onto the eyelashes.

4 Claims, 2 Drawing Sheets

U.S. PATENT DOCUMENTS

| | | | | |
|---|---|---|---|---|
| 5,761,760 | A | 6/1998 | Dumler et al. | |
| 6,260,229 | B1 * | 7/2001 | Edwards et al. | 15/207.2 |
| 6,341,913 | B1 | 1/2002 | Wilson-Jackson | |

FOREIGN PATENT DOCUMENTS

| | | | |
|---|---|---|---|
| FR | 2 754 685 | A1 | 4/1998 |
| JP | A 3-242111 | | 10/1991 |
| JP | A 10-509900 | | 9/1998 |
| JP | 2000-325139 | * | 11/2000 |
| JP | A 2001-212941 | | 8/2001 |
| JP | 2002-129477 | | 5/2002 |

OTHER PUBLICATIONS

Translation of Mar. 10, 2010 Search Report for Malaysian Patent Application No. PI 20043595.

* cited by examiner

BRUSH FOR APPLICATION OF MASCARA OR THE LIKE

TECHNICAL FIELD

The present invention relates to a brush for application of cosmetics such as mascara.

BACKGROUND ART

In conventional mascara brushes, concavity and convexity parts are formed on the bristles thereof in order to make a large amount of mascara adhere on the bristles (for example, Japanese Patent Laid-open No. 2002-129477).

DISCLOSURE OF INVENTION

Problem to be Solved by the Invention

An object of the present invention is to provide mascara brushes with which the amount of mascara to be adhered on the bristles is increased, and mascara can be applied onto the eyelashes quickly and simply by applying a large amount of mascara onto the eyelashes just like gentle stroking.

As the conventional mascara brushes in which a plurality of straight bristles are held on the brush core have free ends of the bristles outwardly and the free ends are generally angular, it is difficult to stroke the eyelashes gently with the mascara brushes. In addition, when the number of the straight bristles is increased in order to increase the amount of mascara to be adhered on the bristles, the free ends are further angular, therefore it becomes still difficult to stroke the eyelashes gently with the mascara brushes.

In case where the mascara brush disclosed in Japanese Patent Laid-open No. 2002-129477 is used, it is easy to make mascara adhere on the bristles thereon, but it is very difficult to transfer the mascara onto the eyelashes.

Means for Solving the Problem

The brush for application of mascara or the like according to the present invention comprises a brush core and a plurality of bristles held on the brush core, in which each of the bristles is in a shape of ring such as circle or ellipse, that is, the bristle is in a shape of a two-dimensional planar curve or a three-dimensional spatial curve, and in which each of the bristles is held on the brush core in such a manner that a face of the planar curve or spatial curve of the ring-shaped bristle is at an angle of 0° to 90° with a longitudinal axis of the brush core, that is, the ring-shaped face of the bristle is from in an identical direction (parallel direction) to a longitudinal axis of the brush core, to in the direction perpendicular to the longitudinal axis of the brush core.

EFFECT OF THE INVENTION

As a large amount of mascara is adhered in a shape of film to the bristles in a shape of ring such as circle or ellipse in the brush for application of mascara or the like according to the present invention, it is possible to apply a large amount of mascara on the bristles. Therefore, the mascara brush according to the present invention makes possible to simply apply a large amount of mascara onto the eyelashes by allowing the film of mascara adhered to the bristles to break with the eyelashes. When the bristles of the brush are rotated around the brush core, the eyelashes are not strongly rubbed with edges of free ends of the bristles but they are gently stroked with the bristles in a shape of ring such as circle or ellipse, because the bristles are in a shape of ring such as circle or ellipse. Consequently, according to the present invention, it is possible to apply quickly, simply and beautifully mascara even in a large amount onto the eyelashes.

BRIEF DESCRIPTION OF THE INVENTION

BEST MODE FOR CARRYING OUT THE INVENTION

The best mode for carrying out the present invention are described based on examples by reference to drawings attached herewith.

Figure 1:
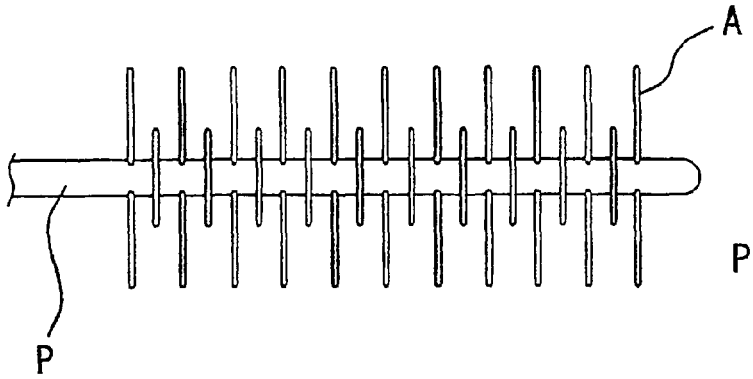
FIG. 1A is a side view showing the brush for application of mascara or the like in Example 1.
FIG. 1B is a front view of the brush shown in FIG. 1A.
Figure 1:
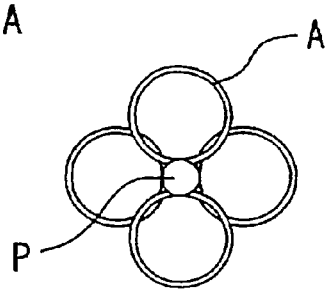

FIGS. 1A and 1B show a brush for application of mascara or the like, comprising a brush core P, and a plurality of bristles A held on the brush core P, wherein each of the bristles A is in a shape of ring such as circle and is held on the brush core P in such a manner that a face of the bristle A is at an angle of 0° to 90° with a longitudinal axis of the brush core P.

Figure 2:
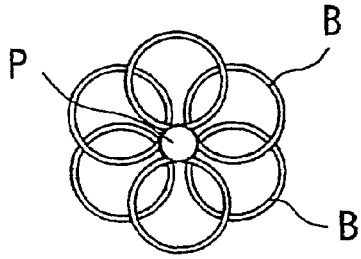
FIG. 2 is a front view showing the brush for application of mascara or the like in Example 2.

FIG. 2 shows a brush for application of mascara or the like, comprising a brush core P, and a plurality of bristles B held on the brush core P, wherein each of the bristles B is in a shape of ring such as circle, has very small grooves having a constant depth or various depth (for example, small grooves having a spiral form) and is held on the brush core P in such a manner that a face of the bristle A is at an angle of 0° to 90° with a longitudinal axis of the brush core P.

Figure 3:
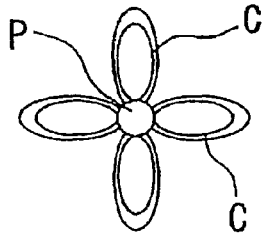
FIG. 3 is a front view showing the brush for application of mascara or the like in Example 3.

FIG. 3 shows a brush for application of mascara or the like, comprising a brush core P, and a plurality of bristles C held on the brush core P, wherein each of the bristles C is in a shape of ring such as ellipse and is held on the brush core P in such a manner that a face of the bristle C is at an angle of 0° to 90° with a longitudinal axis of the brush core P.

Figure 4:
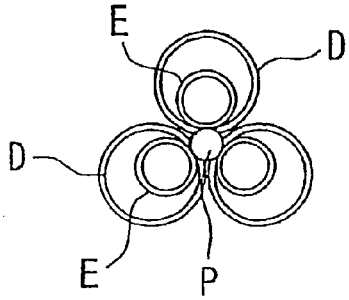
FIG. 4 is a front view showing the brush for application of mascara or the like in Example 4.

FIG. 4 shows a brush for application of mascara or the like, comprising a brush core P, a plurality of first bristles D held on the brush core P and a plurality of second bristles E which are disposed inside of the first bristles D and held on the brush core P, wherein each of the bristles D, E is in a shape of ring such as circle or ellipse and is held on the brush core P in such a manner that a face of the bristle D, E is at an angle of 0° to 90° with a longitudinal axis of the brush core P. In this embodiment, the first bristle D and the second bristle E may be held at the same position or at positions apart from each other on the brush core P.

Figure 5:
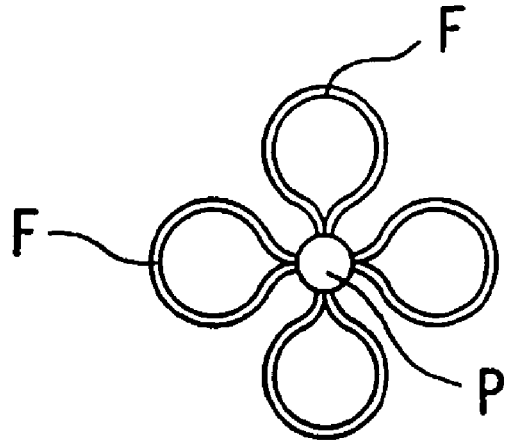
FIG. 5 is a front view showing the brush for application of mascara or the like in Example 5.

FIG. 5 shows a brush for application of mascara or the like, comprising a brush core P, and a plurality of bristles F held on the brush core P, wherein each of the bristles F is in a shape of ring such as circle or ellipse and is held on the brush core P in such a manner that a face of the bristle F is at an angle of 0° to 90° with a longitudinal axis of the brush core P. In the meantime, in this case, a part (a part near to the brush core P) of each bristle F is modified.

Figure 6:
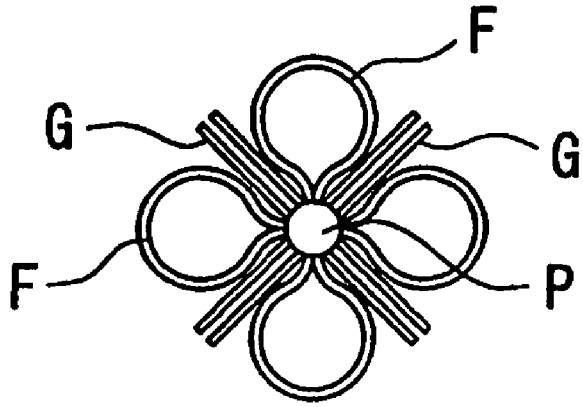
FIG. 6 is a front view showing the brush for application of mascara or the like in Example 6.

FIG. 6 shows a brush for application of mascara or the like, comprising a brush core P, a plurality of ring-shaped bristles F held on the brush core P, and a plurality of straight bristles G held on the brush core P, wherein each of the bristles F (a part of each bristle F is modified as mentioned above) is in a shape of ring such as circle or ellipse and is held on the brush core P in such a manner that a face of the bristle F is at an angle of 0° to 90° with a longitudinal axis of the brush core P.

Figure 7:
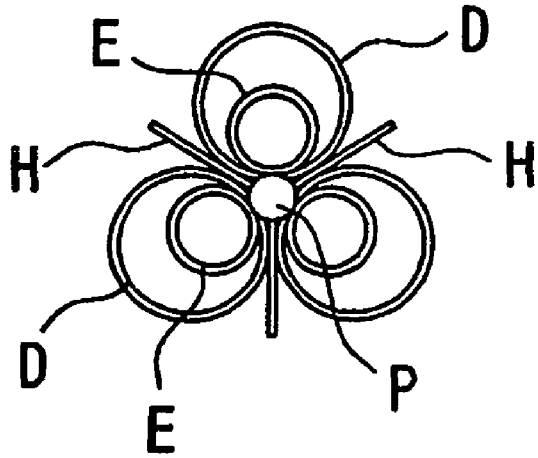
FIG. 7 is a front view showing the brush for application of mascara or the like in Example 7.

FIG. 7 shows a brush for application of mascara or the like, comprising a brush core P, a plurality of first ring-shaped bristles D held on the brush core P and a plurality of second ring-shaped bristles E which are disposed inside of the first bristles D and held on the brush core P, and a plurality of straight bristles H held on the brush core P, wherein each of the bristles D, E is in a shape of ring such as circle or ellipse and is held on the brush core P in such a manner that a face of the bristle D, E is at an angle of 0° to 90° with a longitudinal axis of the brush core P. In the above-mentioned brushes, the bristles A to H may be embedded in the brush core P.

EXAMPLES

The examples of the present invention are described by reference to drawings attached herewith.

Example 1

A brush for application of mascara or the like as shown in FIGS. 1A and 1B was produced. The brush is composed of a brush core P made of a plastic, and a plurality of ring-shaped bristles A which are made of a nylon and held on the brush core P, wherein each of the bristles A is in a shape of circle of planar curve and is held on the brush core P in such a manner that a face of planar curve of the bristle A is at an angle of 90° with a longitudinal axis of the brush core P. FIG. 1A is a side view of the brush according to this example and FIG. 1B is a front view thereof.

Example 2

A brush for application of mascara or the like as shown in FIG. 2 was produced. The brush is composed of a brush core P made of a synthetic resin, and a plurality of ring-shaped bristles B which are made of a polyamide polymer and held on the brush core P, wherein each of the bristles B is in a shape of circle of spatial curve and is held on the brush core P in such a manner that a face of spatial curve of the bristle A is at right angle to a longitudinal axis of the brush core P (at an angle of 90° with a longitudinal axis of the brush core P).

Example 3

A brush for application of mascara or the like as shown in FIG. 3 was produced. The brush is composed of a brush core P made of a polymer, and a plurality of ring-shaped bristles C which are made of an animal hair and held on the brush core P, wherein each of the bristles C is in a shape of ellipse of planar curve and is held on the brush core P in such a manner that a face of planar curve of the bristle C is at an angle of 45° with a longitudinal axis of the brush core P.

Example 4

A brush for application of mascara or the like as shown in FIG. 4 was produced. The brush is composed of a brush core P made of a metal, and a plurality of first bristles D held on the brush core P and a plurality of second bristles E which are disposed inside of the first bristles D and held on the brush core P, wherein each of the bristles D, E is made of a synthetic rubber in a shape of ring such as circle or ellipse of planar curve and is held on the brush core P in such a manner that a face of planar curve of the bristle D, E is at an angle of 30° with a longitudinal axis of the brush core P.

Example 5

A brush for application of mascara or the like as shown in FIG. 5 was produced. The brush is composed of a brush core P made of a metal, and a plurality of bristles F which are made of a nylon and held on the brush core P, wherein each of the bristles F is in a shape of ring such as circle or ellipse of spatial curve and is held on the brush core P in such a manner that a face of the bristle F is at an angle of 60° with a longitudinal axis of the brush core P. In the meantime, in this case, a part (a part near to the brush core P) of each bristle F is modified.

Example 6

A brush for application of mascara or the like as shown in FIG. 6 was produced. The brush is composed of a brush core P made of a plastic, a plurality of ring-shaped bristles F which are made of a nylon and held on the brush core P, and a plurality of straight bristles G which are made of a nylon and held on the brush core P, wherein each of the bristles F (a part of each bristle F is modified as mentioned in Example 5) is in a shape of ring such as circle or ellipse of planar curve and is held on the brush core P in such a manner that a face of the bristle F is at an angle of 800 with a longitudinal axis of the brush core P.

Example 7

A brush for application of mascara or the like as shown in FIG. 7 was produced. The brush is composed of a brush core P, a plurality of first ring-shaped bristles D which are made of an elastic metal wire and held on the brush core P and a plurality of second ring-shaped bristles E which are made of an elastic metal wire that is the same as or different from that of the first bristles, disposed on the same plane and inside of the first bristles D and held on the brush core P, and a plurality of straight bristles H which are made of an elastic metal wire that is the same as or different from that of the first or second bristles and held on the brush core P, wherein each of the bristles D, E is in a shape of ring such as circle or ellipse of planar curve and is held on the brush core P in such a manner that a face of the bristle D, E is at an angle of 75° with a longitudinal axis of the brush core P.

INDUSTRIAL APPLICABILITY

The brush for application of mascara or the like according to the present invention has bristles in a shape of definitive ring and thus can hold thereon a large amount of liquid such as mascara, and gently touches an object to be applied, such as eyelashes due to elasticity of the ring-shaped bristles and thus does not hurt the object. Therefore, the brush can be used for several purposes.

The invention claimed is:

1. A mascara brush, comprising:

a brush core; and bristles held on the brush core, wherein each of the bristles is in a shape of ring, and the bristles extend away from the brush core with substantially equal angular interval therebetween when viewed in an axial direction of the brush core, wherein a face of each bristle becomes a straight line when viewed from a side perpendicular to the axial direction of the brush core.

2. A mascara brush for application of mascara, comprising:

a brush core; and bristles held on the brush core, wherein each of the bristles is composed of a first bristle in a shape of ring and a second bristle in a shape of ring which is disposed inside of the first bristle, and the bristles extend away from the brush core with a substantially equal angular interval therebetween when viewed in an axial direction of the brush core, wherein a face of each bristle becomes a straight line when viewed from a side perpendicular to the axial direction of the brush core.

3. A mascara brush for application of mascara, comprising:

a brush core;

ring-shaped bristles held on the brush core; and straight bristles held on the brush core, wherein each of the ring-shaped bristles is in a shape of ring, and the ring-shaped bristles extend away from the brush core with a substantially equal angular interval therebetween when viewed in an axial direction of the brush core, wherein a face of each ring-shaped bristle becomes a straight line when viewed from a side perpendicular to the axial direction of the brush core.

4. A mascara brush for application of mascara, comprising:

a brush core;

ring-shaped bristles held on the brush core; and straight bristles held on the brush core, wherein each of the ring-shaped bristles is composed of a first bristle in a shape of ring and a second bristle in a shape of ring which is disposed inside of the first bristle, and the ring-shaped bristles extend away from the brush core with a substantially equal angular interval therebetween when viewed in an axial direction of the brush core, wherein a face of each ring-shaped bristle becomes a straight line when viewed from a side perpendicular to the axial direction of the brush core.

* * * * *